US010652975B2

(12) United States Patent
Winderlich

(10) Patent No.: US 10,652,975 B2
(45) Date of Patent: May 12, 2020

(54) LAMP SYSTEM HAVING A GAS-DISCHARGE LAMP AND OPERATING METHOD ADAPTED THEREFOR

(71) Applicant: Heraeus Noblelight GmbH, Hanau (DE)

(72) Inventor: Jan Winderlich, Frankfurt (DE)

(73) Assignee: Heraeus Noblelight GmbH, Hanau (DE)

( * ) Notice: Subject to any disclaimer, the term of this patent is extended or adjusted under 35 U.S.C. 154(b) by 0 days.

(21) Appl. No.: 16/345,557

(22) PCT Filed: Oct. 18, 2017

(86) PCT No.: PCT/EP2017/076529
§ 371 (c)(1),
(2) Date: Apr. 26, 2019

(87) PCT Pub. No.: WO2018/077678
PCT Pub. Date: May 3, 2018

(65) Prior Publication Data

US 2019/0254151 A1 Aug. 15, 2019

(30) Foreign Application Priority Data

Oct. 28, 2016 (DE) ..... 10 2016 120 672

(51) Int. Cl.
*H05B 45/10* (2020.01)
*H05B 41/39* (2006.01)
(Continued)

(52) U.S. Cl.
CPC ..... *H05B 41/39* (2013.01); *H01J 61/523* (2013.01); *H05B 41/295* (2013.01); *H01J 61/20* (2013.01)

(58) Field of Classification Search
CPC .... H05B 45/10; H05B 45/22; H05B 41/3922; H05B 47/11; H05B 47/105; Y02B 20/46
See application file for complete search history.

(56) References Cited

U.S. PATENT DOCUMENTS 4,529,912 A 7/1985 Northrup et al.
4,533,853 A * 8/1985 Hammond ..... H01J 61/52 250/205
(Continued)

FOREIGN PATENT DOCUMENTS

DE 10129755 1/2003
DE 102008044294 6/2010
(Continued)

OTHER PUBLICATIONS

German Office Action dated Jul. 27, 2017 in corresponding German Patent Application No. 102016120672.5.
(Continued)

*Primary Examiner* — Haissa Philogene
(74) *Attorney, Agent, or Firm* — Stradley Ronon Stevens & Young, LLP

(57) ABSTRACT

A lamp system, and a method of operating the lamp system, are provided. The lamp system includes a gas discharge lamp, an electronic ballast and a control unit. A performance influencing control variable of the lamp system is used. The method allows operation with a high emission performance independent of the design thereof and of any potential changes caused by lamp aging and without any knowledge of the optimal operating temperature. According to the invention a light intensity control is provided, in which an actual value of a light intensity emitted by the gas discharge lamp is measured using a light sensor and the emitted light intensity is used as an actuating variable.

17 Claims, 2 Drawing Sheets

(51) Int. Cl.

| | |
|---|---|
| ***H01J 61/52*** | (2006.01) |
| ***H05B 41/295*** | (2006.01) |
| *H01J 61/20* | (2006.01) |

(56) References Cited

U.S. PATENT DOCUMENTS

| | | | | |
|---|---|---|---|---|
| 5,250,799 | A * | 10/1993 | Werner | H05B 41/3922 250/214 AL |
| 5,367,227 | A * | 11/1994 | Gademann | H05B 41/042 315/290 |
| 6,398,970 | B1 * | 6/2002 | Justel | C02F 1/325 210/198.1 |
| 6,906,468 | B2 * | 6/2005 | Riepe | H05B 41/2988 315/104 |
| 8,541,948 | B2 | 9/2013 | Konrad et al. | |
| 9,048,083 | B2 | 6/2015 | Voronov | |
| 9,504,129 | B2 * | 11/2016 | Vogt | H05B 37/0218 |
| 2008/0156738 | A1 | 7/2008 | Albrecht | |
| 2011/0234103 | A1 | 9/2011 | Konrad et al. | |
| 2013/0020942 | A1 | 1/2013 | Voronov | |
| 2013/0309131 | A1 | 11/2013 | Engelhard | |
| 2015/0264785 | A1 * | 9/2015 | Lott | H05B 41/39 315/117 |

FOREIGN PATENT DOCUMENTS

| | | |
|---|---|---|
| DE | 102008060778 | 6/2010 |
| DE | 102010014040 | 10/2011 |
| GB | 2316246 | 2/1998 |
| WO | 2005102401 | 11/2005 |
| WO | 2007025376 | 3/2007 |
| WO | 2014056670 | 4/2014 |

OTHER PUBLICATIONS

International Search Report and Written Opinion dated Jan. 3, 2017 for PCT Application PCT/EP2017/076529.

Zhang et al., "Extremum-Seeking Control and Applications: A Numerical Optimization-Based Approach", Advances in Industrial Control, Springer-Verlag London, 2012, pp. 3-29.

* cited by examiner

LAMP SYSTEM HAVING A GAS-DISCHARGE LAMP AND OPERATING METHOD ADAPTED THEREFOR

CROSS REFERENCE TO RELATED APPLICATIONS

This application is a U.S. National Phase filing of international patent application number PCT/EP2017/076529 filed Oct. 18, 2017 that claims the priority of German patent application number 102016120672.5 filed Oct. 28, 2016. The disclosures of these applications are hereby incorporated by reference in their entirety.

FIELD

The invention relates to a method for operating a lamp system including a gas discharge lamp, an electronic ballast, and a control unit for controlling a performance influencing control variable of the lamp system.

BACKGROUND

In order to ensure a maximum emission performance that is independent from ambient conditions, it has been suggested to control the temperature of the amalgam depot. In the fluorescent tube known from DE 101 29 755 A1, a temperature sensor is arranged in the proximity of the amalgam depot, and the amalgam depot is heated by means of an adjustable heater as a function of the determined temperature.

In the sterilization device known from WO 2005/102401 A2, which includes a UV lamp, the surface temperature of the lamp bulb is measured by means of a temperature sensor and, at the same time, the UV radiation emission is measured by means of a UV sensor. In order to ensure an optimal operating temperature and emission performance of the lamp, it is suggested that the lamp should be cooled or heated depending on the determined temperature using a blower unit.

GB 2 316 246 A describes a dimmable fluorescence lamp which is equipped with an independent heating circuit for the lamp heater, wherein the heating circuit can be energized separately from the actual power current. The current required by the electrode heater is detected by a temperature sensor.

The gas discharge lamp according to WO 2014/056670 A1 is provided with an electronic ballast and a cooling element for cooling the gas discharge lamp, which can be adjusted via a control unit. In order to reach a high emission performance, it is suggested that, with the lamp current being constant, the lamp voltage is used as control variable and the cooling power is used as actuating variable.

SUMMARY

In accordance with an exemplary embodiment of the invention, a method for operating a lamp system is provided. The lamp system includes a gas discharge lamp, an electronic ballast and a control unit for controlling a performance influencing control variable of the lamp system. The method includes providing a light intensity control in which an actual value of a light intensity emitted by the gas discharge lamp is measured using a light sensor and the emitted light intensity is used as a control variable.

In accordance with another exemplary embodiment of the invention, a lamp system is provided. The lamp system includes a gas discharge lamp, an electronic ballast, a control unit for controlling a performance influencing control variable of the lamp system, and a light sensor for determining an actual value of a light intensity emitted by the gas discharge lamp. The control is configured as a light intensity control wherein the emitted light intensity is used as control variable, wherein the actual value of the light intensity is available at a signal input of the control unit as an input signal.

BRIEF DESCRIPTION OF THE DRAWINGS

The invention is best understood from the following detailed description when read in connection with the accompanying drawings. It is emphasized that, according to common practice, the various features of the drawings are not to scale. On the contrary, the dimensions of the various features are arbitrarily expanded or reduced for clarity. Included in the drawings are the following figures.

DETAILED DESCRIPTION

Figure 1:
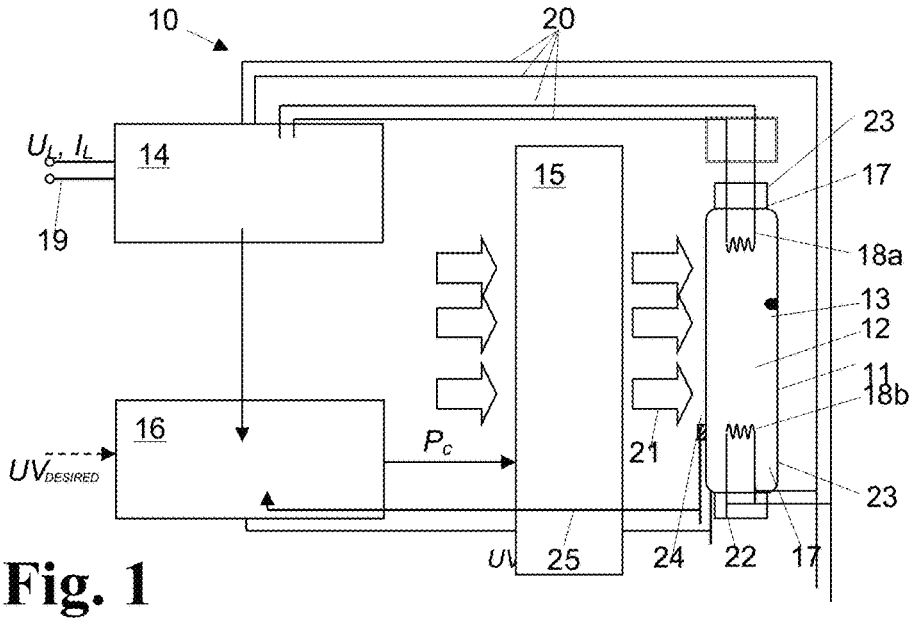
FIG. 1 illustrates a lamp system for generating ultraviolet radiation with a low pressure amalgam radiator in accordance with an exemplary embodiment of the invention.

Aspects of the invention relate to a method for operating a lamp system including a gas discharge lamp, an electronic ballast, and a control unit for controlling a performance influencing control variable of the lamp system.

Furthermore, the invention relates to a lamp system for performing the method, the lamp system including a gas discharge lamp, an electronic ballast, and a control unit for controlling a performance influencing control variable of the lamp system.

Gas discharge lamps include mercury vapour lamps, fluorescence lamps or sodium vapour lamps. The emission performance of mercury-containing UV discharge lamps has its maximum at a specific partial pressure of mercury. Accordingly, there is an optimal operating temperature at which the emission performance of the gas discharge lamp is at its maximum. In gas discharge lamps in which a part of the mercury is present not in liquid form but as an alloy (amalgam), there will be a balance between the mercury bound in the amalgam and the free mercury, which is also dependent on the operating temperature of the gas discharge lamp, in particular, on the temperature of the amalgam depot.

The electrical connected load of the gas discharge lamp is configured for an emission performance that is as high as possible during continuous operation, with the ambient conditions taken into account. However, the operating temperature actually reached during operation is often different from the designed temperature. For example, overheating due to a high ambient air temperature or insufficient ventilation may result in a temperature that is different from the optimal operating temperature. Lamp aging may also lead to changes in emission.

In the known control methods, the nominal lamp current is applied when the UV lamp is turned on and will normally be kept at an almost constant level during operation of the UV lamp. Altered operating conditions of the UV lamp, particularly the temperature, will lead to undesired changes in the emission performance. In order to counteract this, a certain degree of previous knowledge is needed about the radiator type so that, for example, a temperature control circuit can be adjusted. In addition, changes which are caused by lamp aging and would require an adjustment of the electrical connected load are not taken into account either.

Aspects of the invention are therefore based on the object of specifying a method for operating a gas discharge lamp, the method allowing operation with a high emission performance independent of the design thereof and of any potential changes caused by lamp aging, in particular even if the optimal operating temperature is unknown. Furthermore, the invention is based on the object of providing a lamp system which can be operated with high emission performance even if operating conditions are changing and even if changes due to lamp aging occur.

As regards the method and based on a method of the aforementioned genus, certain objects are solved according to the invention by providing a light intensity control, which uses a light sensor to measure an actual value of a light intensity emitted by the gas discharge lamp and which uses the emitted light intensity as a control variable.

Usually, gas discharge lamps are subject to power-controlled or, in some cases, current-controlled operation, wherein the connected load or the supply current are configured for an optimal concentration of the charge carrier in the discharge chamber or for an optimal temperature and, thus, for maximum light intensity. Accordingly, conventional lamp systems react to deviations from the ambient temperature and accompanying changes in the operating temperature of the gas discharge lamp by adjusting operating parameters, such as current, voltage or temperature of an amalgam depot.

In certain lamp systems according to the invention, however, the light intensity of the gas discharge lamp is the performance influencing desired variable of the control. The emitted light intensity is therefore not only measured as usual but also additionally controlled to reach a maximum or a predefined threshold value that is lower than the actual maximum emission value, using a lamp control value having an effect on the light intensity.

If the term "maximum" of the light intensity is used in the following, this term also includes a "predefined threshold value of the light intensity", unless explicitly stated otherwise.

As a result, the light intensity, in particular the emitted UV power, always remains within the range of the desired value, i.e., the maximum or the predefined threshold value, regardless of the ambient conditions, even if neither the current operating temperature nor an optimal operating temperature are known.

The maximum of the light intensity can, in general, be specified for a lamp type and, where appropriate, does then not need to be determined for each individual gas discharge lamp. In case of a different embodiment, the maximum of the light intensity is individually determined for each gas discharge lamp at the factory. In this case, the individually determined desired value is stored in a memory unit of the lamp system and will then be read by the control unit when the gas discharge lamp is being turned on. In a further embodiment, the current maximum of the light intensity is unknown when the gas discharge lamp is being turned on and is individually determined when the gas discharge lamp is being turned on. Where appropriate, the lamp intensity is individually determined whenever the lamp is turned on or in predefined turn-on cycles and/or operation periods.

Preferably, the operating method according to the invention is used with a gas discharge lamp which emits UV radiation. The spectral range for ultraviolet radiation relevant for gas discharge lamps is from 184 nm to 380 nm, with the emphasis on 254 nm. Where appropriate, a light intensity containing UV light from the wavelength range of 170 to 380 nm is also preferably used as the light intensity to be controlled, and most preferably the intensity of UV radiation emitted by the gas discharge lamp comprising radiation of the wavelength 254 nm is used. The emission spectrum of mercury vapour lamps shows a characteristic and distinct line at 254 nm (UVC radiation) which is perfectly suitable for control.

Under the keyword "extremum control", control engineering knows a number of methods for finding a maximum of a control variable and the subsequent control to reach this found maximum.

Therefore, a preferred method variant of the method according to the invention provides that a target value for an actuating variable is determined with extremum control, in which the light intensity reaches a maximum or a predefined threshold value.

Extremum control involves a maximum value determination of the light intensity, and as a result, a desired value for the control variable, i.e., for the light intensity, is transferred to the control unit. This desired value remains constant during the subsequent operating phase or is continuously reset from time to time or as required.

In a first preferred embodiment of extremum control, this control is realized as a two-point control in which during a start phase the actuating variable is set to at least two initial values, one of which causes a temperature increase and the other of which causes a temperature reduction of the gas discharge lamp, wherein a maximum of the light intensity is reached and overstepped both as a result of the temperature increase and as a result of the temperature reduction, and in that a value between the one and the other initial value is set as the target value of the actuating variable.

Figure 3:
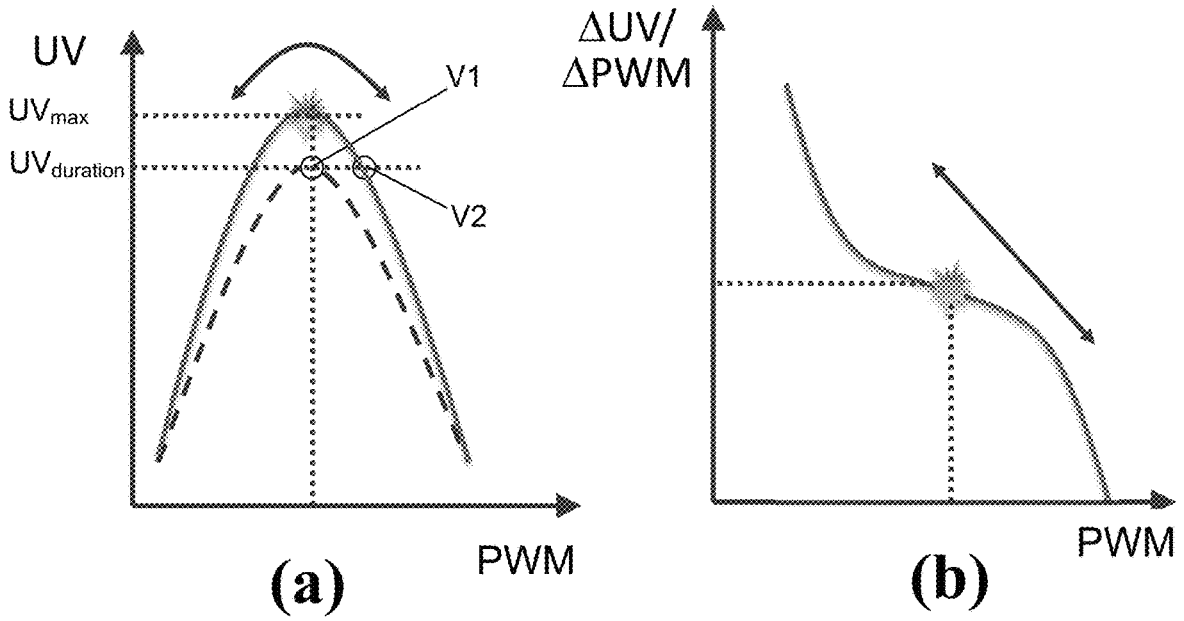
FIG. 3 is a diagram for illustrating the setting of the maximum of the light intensity on the basis of a control based on the curvature determination of a transfer function of the actuating variable and the light intensity in accordance with an exemplary embodiment of the invention.

The two-point control is based on the fact that the control variable, i.e., the light intensity in this case, has a relative maximum as a function of the actuating variable. For example, amalgam lamps have a maximum UV power at a specific mercury vapour pressure which, in turn, is correlated with the temperature of the amalgam depot. The temperature of the amalgam depot may, in turn, be dependent on a different parameter, for example, the cooling or heating power of a temperature control element taking effect on the amalgam depot. This type of dependency of the light intensity on an actuating variable having a distinct maximum is schematically shown in FIG. 3(*a*). It allows determining the maximum with two initial values of the actuating variable (or the parameter correlated therewith) on either side of the maximum, wherein the initial values are changed such that the maximum in the diagram of FIG. 3(*a*) is reached and overstepped once from the left side and once from the right side.

As compared with other methods of extremum control, the two-point control used here is particularly suited for being employed in relatively slow control systems, as it is the case with the light intensity of the gas discharge lamp.

In a second, likewise preferred embodiment of extremum control, this control includes determining the curvature of a transfer function of the actuating variable and the light intensity, wherein the target value is determined on the basis of the maximum of the light intensity.

This type of control is also based on the fact that the light intensity has a relative maximum depending on the actuating variable. In practice, however, the maximum of the light intensity is not determined directly but only indirectly, by the control being configured as a differential control which uses the 2nd derivative of the transfer function. Since the transfer function is not monotonic, it is not possible to infer the correct control direction when the light intensity changes. However, the first derivative is monotonic and has a zero point when the actuating variable is set to its optimal value (=max. light intensity). The change in the actuating variable now results from the negative increase of this function (=2nd derivative of the transfer function). This embodiment of extremum determination is perfectly suited for control because, after the optimal value has been reached, the actuating variable no longer changes under constant ambient conditions (in contrast to two-point control and to traditional "extremum seeking control" algorithms). The control based on determining the curvature does not require any complex determination of the maximum of the light intensity and allows continuous control without steps. It requires comparatively few control interventions, which has a positive effect on the service life of the actuator providing the actuating variable, such as a fan, and is therefore less noticeable audibly than other controls.

In comparison to other methods of extremum control, this control method also proves to be particularly suitable for use with the comparatively slow control system such as herein.

A deviation of the light intensity from a previously determined maximum can indicate a change in the environment of the gas discharge lamp, in particular a temperature change with an influence on the light intensity, such as the temperature of an amalgam depot. It is appropriate to use the relevant temperature or a parameter that can be changed and is mathematically clearly correlated with the temperature as actuating variable for the light intensity control.

With this in mind, a particularly preferred method variant is characterized by the fact that an operating temperature of the gas discharge lamp that influences the light intensity can be changed by using a temperature control element with adjustable temperature control capacity, and that the temperature control capacity is used as the actuating variable of the control. Temperature control is achieved by using a gaseous, liquid or solid temperature control medium. If it is solid, the temperature control element can, for example, be realized as a Peltier element or as an array of a plurality of Peltier elements.

For example, the operating temperature is a characteristic temperature in the proximity of the surface of the gas discharge lamp or the temperature of an amalgam depot. Temperature control includes increasing, reducing or maintaining this temperature using the temperature control element. Therein, the use of a fan with PWM-controlled ventilation power as a temperature control element has proved to be particularly effective, wherein the ventilation power is used as the actuating variable for the control system.

If the fan is PWM-controlled (PWM=pulse width modulation), the fan is provided with its own control chip. In contrast to fan control with variable voltage, PWM fan control has no starting voltage below which the fan rotor no longer rotates. Thereby, the speed can be regulated down to very small values. Further, PWM control does not pose the problem of waste heat caused by the variable resistance of the voltage control. Herein, the temperature control capacity as the actuating variable of the control is the ventilation power, which, for example, can be specified in revolutions of the fan rotor per time unit or as the mass or volume flow of a gaseous temperature control medium. Cooling and heating processes, such as herein the temperature control of the gas discharge lamp, basically result in a slow control system, for which continuous control via PWM has proved to be particularly advantageous.

The control unit sends a control signal regulating the cooling capacity to the temperature control element for setting the operating temperature, depending on the determined deviation from the target value of the light intensity.

The light intensity measured as the control variable may refer to the emission of a specific wavelength and/or to the emission of a wavelength range. A method variant that has proved particularly successful is one in which the intensity of the UV radiation emitted by the gas discharge lamp is used as light intensity, wherein the UV radiation includes radiation at a wavelength of 254 nm.

In a particularly preferred method variant, a threshold value of the light intensity is predefined, wherein falling below this threshold value indicates the end of the service life of the gas discharge lamp, wherein this threshold value is used as the desired value of the light intensity control.

The light intensity—and, therefore, the specific UV intensity as well—decreases over the service life of the gas discharge lamp. A drop to, for example, 50% to 90% of the initial performance, can be defined as the end of the service life of the radiator. With the help of this invention, a gas discharge lamp can be operated with a constant UV power corresponding to the specified threshold value over its entire service life. In the following, this method will be referred to as "service life compensation". For this purpose, the threshold value $UV_{duration}$ of the light intensity is set to a lower threshold value which indicates the end of the service life of the radiator, for example, to a value within the range from 50% to 90% of the initial maximum light intensity.

In a first method variant of the "service life compensation", operating parameters having an effect on the light intensity, such as supply voltage, supply current or supply power or the temperature of an amalgam depot, are set in standard operating mode such that a light intensity that is reduced as compared to the maximum possible light intensity $UV_{max}$ develops at a lower relative intensity maximum $UV_{duration}$. The light intensity is regulated to this lower maximum $UV_{duration}$, wherein the extremum control according to the invention discussed above can be used for this purpose. Therein, the intentionally reduced, lower relative maximum $UV_{duration}$ of the light intensity, being the desired value, takes the place of the absolute maximum $UV_{max}$ of the light intensity.

It is true that, in a further method variant of the "service life compensation", the operating parameters having an effect on the light intensity, such as supply voltage, supply current or supply power or the temperature of an amalgam depot, are set to optimal values in standard operating mode, with the result that, theoretically, the maximum possible light intensity $UV_{max}$ could be generated. But the threshold value of the light intensity, being the desired value of the temperature control, is not set to the maximum light intensity $UV_{max}$ but, for example, to a value which is below this maximum value by about 10 to 50 percentage points.

In both method variants, the lower threshold value can, therein, be defined based on the specification, i.e., without individual measurement, or it is defined as a percentage of the initial maximum (=100%) of the light intensity as it is, for example, determined on the initial start-up of the gas discharge lamp. In the latter case, the initial maximum and/or the initial desired value are filed in a memory of the lamp system and read from the memory when the gas discharge lamp is being turned on.

With regard to the lamp system for performing the method, the above-mentioned object, starting from a lamp system of the aforementioned type, is solved according to the invention by a light sensor for determining an actual value of a light intensity emitted by the gas discharge lamp being provided, and the control being configured as a light intensity control, in which the emitted light intensity is used as a control variable, the actual value of the light intensity being available as an input signal at a signal input of the control unit.

In the lamp system according to the invention, the light intensity of the gas discharge lamp is the performance influencing desired variable of the control. A sensor is provided for measuring the emitted light intensity, preferably the UV intensity of a gas discharge lamp emitting UV radiation. The sensor, preferably a UV sensor, is part of the gas discharge lamp or it is positioned in the emission range of the gas discharge lamp, for example, in a base or a frame or a housing of the lamp system.

The UV sensor is configured to detect the emission of a specific wavelength and/or the emission of a wavelength range, preferably the UV radiation emitted by the gas discharge lamp, wherein the UV radiation includes radiation at a wavelength of 254 nm.

The control is configured for extremum control. It is adapted to control the light intensity to a maximum or a predefined threshold value. Thereby, the light intensity, more particularly the emitted UV power, always remains within the range of the desired value, i.e., the maximum or the predefined threshold value, irrespective of the ambient conditions.

The maximum of the light intensity may generally be specified for a lamp type, it can be individually specified for each gas discharge lamp at the factory, or it is read by the control unit when the gas discharge lamp is being turned on.

In a preferred embodiment of the lamp system according to the invention and with regard thereto, the control unit includes a device for extremum control in which a target value is determined for an actuating variable at which target value the light intensity adopts a maximum or a predefined threshold value.

Therein, the extremum control preferably is realized as a two-point control or as a curvature determination of a transfer function of the actuating variable and the light intensity. In this context, the explanations on the method according to the invention are also applicable to the lamp system.

Preferably, the temperature of an amalgam depot of the gas discharge lamp is used as the actuating variable. Therein, the lamp system is preferably equipped with a temperature control element with controllable temperature control capacity which is suitable for changing an operating temperature of the gas discharge lamp that influences the light intensity, wherein the operating temperature or a parameter correlated with the operating temperature is available at a signal input of the control unit and can be used as an actuating variable of the light intensity control.

The temperature control element is operated with a gaseous, liquid or solid temperature control medium. If it is solid, the temperature control element can, for example, be realized as a Peltier element or as an array of a plurality of Peltier elements.

For example, the operating temperature is a characteristic temperature in the proximity of the surface of the gas discharge lamp or the temperature of an amalgam depot. Temperature control includes increasing, reducing or maintaining this temperature using the temperature control element.

A temperature control element with controllable cooling or heating capacity has proved particularly successful, in particular a fan with PWM-controlled ventilation power, which is connected to the control unit.

FIG. 1 shows a lamp system for generating ultraviolet radiation, which is generally provided with the reference symbol 10. The lamp system 10 includes a low pressure amalgam radiator 11, an electronic ballast 14 for the low pressure amalgam radiator 11, a radial fan 15 for cooling the low pressure amalgam radiator 11, and a control unit 16 for the radial fan 15.

The low pressure amalgam radiator 11 is operated with an essentially constant lamp current at a nominal power of 200 W (at a nominal lamp current of 4.0 A). It has a lighting length of 50 cm, an outside radiator diameter of 28 mm, and a power density of about 4 W/cm.

In the discharge chamber 12 which is filled with a gas mixture consisting of argon and neon (50:50), two helical electrodes 18*a*, 18*b* are disposed opposite each other, with a discharge arc being ignited between said electrodes 18*a*, 18*b* during operation. In the discharge chamber 12, at least one amalgam depot 13 is located at a gold point of the sleeve bulb.

The sleeve bulb of the low pressure amalgam radiator 11 is closed with pinches 17 at either end, with a power supply 18 being passed there through and with said pinches 17 being held in bases 23. A memory element 22 in the form of an EEPROM is arranged in one of the bases 23. In an alternative embodiment of the lamp system, the separate memory chip in the base of the gas discharge lamp is done without, and the data required are stored in the central control unit 16.

A UV sensor 24 is arranged in the proximity of one end of the sleeve bulb. It is a commercially available photodiode made of silicon carbide (SiC) which is characterized by its insensitivity to daylight and its long-term stability. It detects UVC radiation, including the wavelength of 254 nm, a main emission line of the low pressure amalgam radiator 11. The UV sensor 24 is connected to the control unit 16 via a data line 25. During operation, the control unit 16 determines the UVC light intensity measured by the UV sensor 24 as an actual value $UV_{actual}$ of the light intensity control.

The low pressure amalgam radiator 11 is operated at the electronic ballast 14 and is connected to the same via the connection lines 20. Furthermore, the electronic ballast 14 has a line voltage connection 19.

The radial fan 15 is provided with a PWM (pulse width modulation) signal for controlling the speed of the rotor. The speed determines the cooling capacity thereof, which can be adjusted between 0 and 200 $m^3/h$ by a cooling air volume flow.

The light intensity serves as a variable desired value, and the cooling capacity of the radial fan 15 is the actuating variable of the lamp control. Therein, the light intensity is set to a maximum or a predefined threshold value that is lower than the actual maximum value of the emission. Thereby, the light intensity always remains within the range of the desired value, i.e., the maximum or the predefined threshold value, irrespective of the ambient conditions. In the following, the operating and control methods are illustrated in more detail on the basis of three methods.

Figure 2:
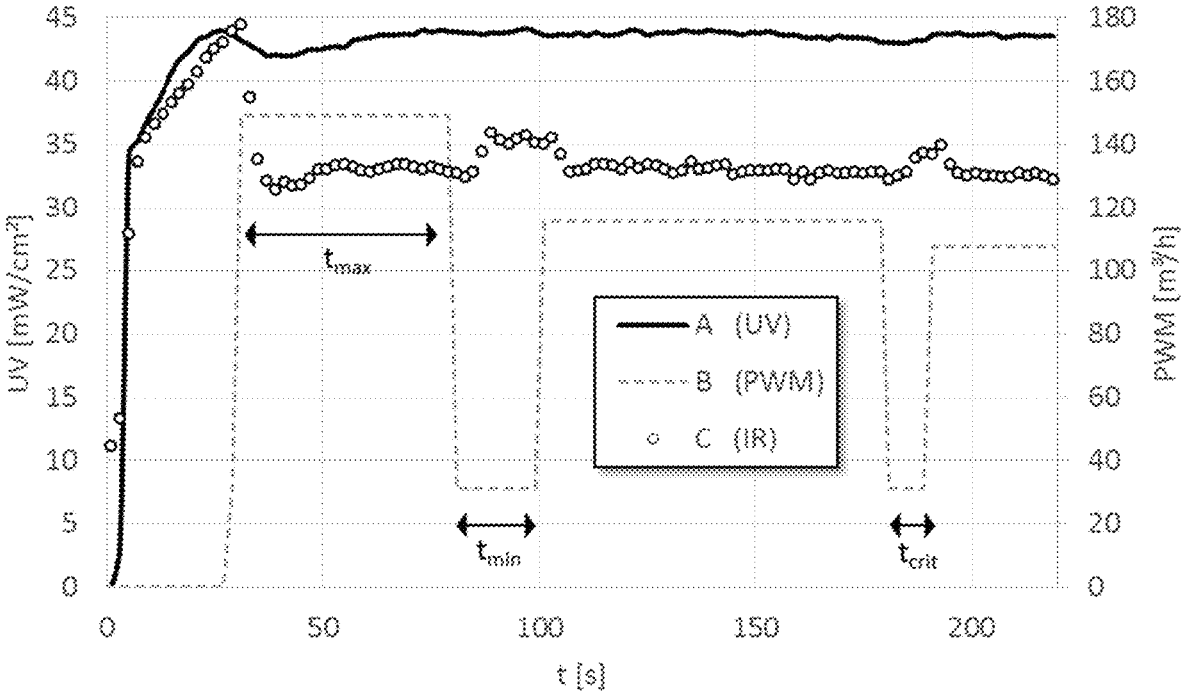
FIG. 2 is a diagram for illustrating the determination of the maximum of the light intensity on the basis of a two-point control in accordance with an exemplary embodiment of the invention.

The diagram of FIG. 2 illustrates a procedure for determining the desired value of the light intensity by the example of a two-point control. It shows time curves of the measured light intensity (curve A), the cooling capacity (curve B, measured as PWM), and the temperature of the amalgam depot 13 (curve C; measured using an IR sensor). The light intensity UV measured by the UV sensor is plotted along the left-hand ordinate in $mW/cm^2$, while the cooling air volume flow PWM is plotted along the right-hand ordinate in $m^3/h$. In the temperature curve also entered in the diagram (curve C), the temperatures are not specifically scaled relative values. The unit of the time axis t are seconds (s).

Initially, the fan 15 (curve B) remains off. The UV light intensity (curve A) rapidly increases, reaches a maximum and then drops. The drop of the UV light intensity can be attributed to an excessively high temperature of the sleeve bulb of the lamp and the amalgam depot 13 (curve C). Thereafter, the fan 15 is operated at maximum speed ($fan_{max}$) until the lamp bulb (more specific: the temperature of the amalgam depot 13) is undercooled and the UV light intensity therefore drops again. The duration of this time interval is $t_{max}$.

Thereafter, the fan 15 is operated for a time $t_{min}$, at low speed ($fan_{min}$) (so that it just still rotates) until the gas discharge lamp overheats again and the UV light intensity drops again.

The result of this starting phase is an initial value for the default speed of the fan 15, such as it is used as a measure for the cooling capacity during the further operation of the gas discharge lamp. This default speed can be calculated as follows:

$$Fan_{default}=(fan_{max}*t_{max}+fan_{min}*t_{min}/(t_{min}+t_{max})) \quad (1)$$

The UV light intensity developing at the cooling capacity $fan_{default}$ is the desired value $UV_{desired}$ for the lamp control and simultaneously represents the maximum value. If the UV light intensity falls below a critical threshold (for example 98% of the maximum value) during operation, the fan is switched to minimum operating mode ($fan_{min}$) and the UV light intensity is checked during a reaction time $t_{crit}$ as to whether it rises again. If necessary, the value for $fan_{default}$ is reduced. Otherwise, the fan is operated at the maximum $fan_{max}$ and the default checking direction is changed (from $fan_{min}$ to $fan_{max}$).

The time constant $t_{crit}$ can be determined by a simple test using a step function, even automatically from the reaction time of the UV light intensity after the fan has been turned on for the first time.

A further procedure for determining the desired value of the light intensity and the operation of the lamp system is illustrated in FIG. 3 by the example of a curvature determination with a transfer function of the actuating variable and the light intensity. The diagram of FIG. 3(*a*) shows the dependency of the UV light intensity UV on the cooling capacity PWM (for example, the fan speed). The UV light intensity shows a distinct maximum at optimal cooling capacity. Since the transfer function (FIG. 3(*a*)) is not monotonic, it is not possible to infer the correct control direction when the light intensity changes.

The schematic diagram of FIG. 3(*b*) shows the mathematical derivative of the function of FIG. 3(*a*). The first derivative ΔUV/ΔPWM is now also monotonic and has a zero point at optimal cooling capacity (=max. light intensity). The command for changing the actuating variable ΔPWM now directly results from the negative increase of this function (~−$dUV^2/d^2PWM$=2nd derivative of the transfer function=curvature).

The following alteration has proved to be technically expedient, wherein the setting of the fan is made according to the following equation:

$$\Delta PWM=Const.*sign(\Delta PWM_{alt})*sign(d^2UV)*abs(\Delta UV) \quad (2).$$

The direction of the change in the actuating variable between the time step n and the next one at n+1 results from the sign of the 2nd derivative. This derivative is composed of the three UV values last measured ($d^2UV=UV_n-2*UV_{n-1}+UV_{n-2}$) and the two fan settings last set ($\Delta PWM_{alt}=PWM_n-PWM_{n-1}$). However, the amount of the alteration to the next time step $\Delta PWM=PWM_{n+1}-PWM_n$ is scaled with the amount of the alteration of the UV intensity ΔUV and a parameter Const., i.e.: $Const*abs(UV_{n-1}+UV_{n-2})$.

Figure 4:
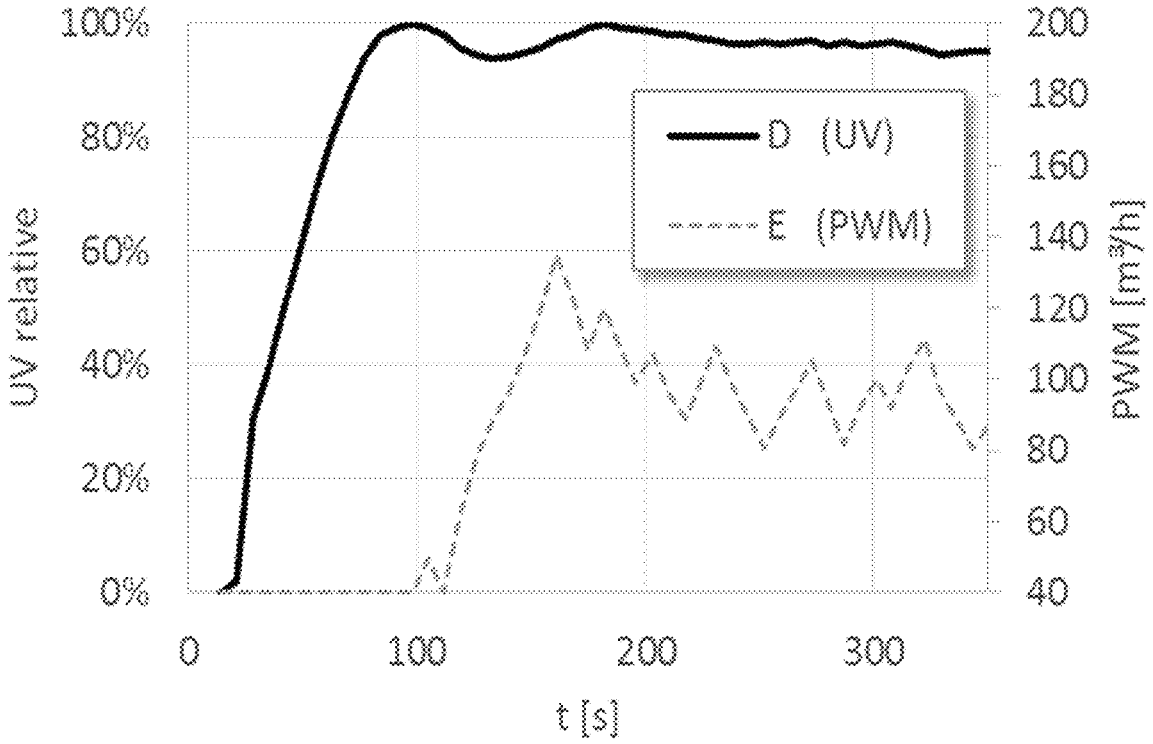
FIG. 4 is a diagram with the time curves of UV intensity and fan capacity for a method in accordance with an exemplary embodiment of the invention.

FIG. 4 shows the time curves of the UV light intensity (curve D) and the associated cooling capacity (fan speed or cooling air volume flow, respectively, curve E). The light intensity $UV_{relative}$ (in %) is plotted along the left-hand ordinate as a relative value in relation to the maximum light intensity while the cooling air volume flow in $m^3/h$ is plotted along the right-hand ordinate. Despite the slowness of the control system, which results from the temperature control of the gas discharge lamp as the actuating variable, this continuous control using the PWM-controlled radial fan 15 generates a largely constant UV light intensity, as shown by curve D.

Under unfavorable conditions, however, this UV control may become instable via the curvature determination and the fan may be changed to the wrong direction. This case is governed by the control as soon as the UV light intensity falls below a critical threshold (for example, 95% of the maximum value; UV<95% of $UV_{max}$) during operation. The fan speed will then be disturbed intentionally, i.e., the speed is changed radically, for example, to zero if the previous PWM value was 50% or higher, or to the maximum PWM value (100%) if the previous PWM value was less than 50%, in order to generate a clear control signal. Subsequently, this disturbance is not allowed for x time steps, in order to give the control time to make the setting.

A further method for operating and controlling the lamp system is based on an absolute measurement of the UV light intensity to a predefined value (and not on the control to the relative maximum of the UV light intensity, as described for the two above procedures).

It is known that the UV power decreases to, for example, 90% of the initial power over the service life of the radiator. With the help of the absolute control, a gas discharge lamp can be operated with a constant UV power over its entire service life. For the purpose of this "service life compensation", the initial amount of the UV light intensity is determined when the gas discharge lamp is turned on for the first time (@0 h) ($UV_{max@0h}$=100%) and, from this, the UV light intensity $UV_{duration}$=90% of $UV_{max@0h}$ to be kept constant over the service life is determined and stored either in the memory element 22 of the lamp system or in the lamp control.

In a first method variant, when the gas discharge lamp is turned on the next time, the UV light intensity is first taken into the maximum and then the lamp current is reduced until the predefined desired value $UV_{duration}$=90% of $UV_{max@0h}$ is reached. The control repeatedly takes the fan setting into the relative maximum in order to maintain this desired value. In FIG. 3(*a*), this method variant which has an operating parameter (lamp current) adjusted to $UV_{duration}$ is indicated by the dashed curve V1 with the relative maximum $UV_{duration}$ of the light intensity.

In a further method variant, the control unit 16 compares the actual value of the UV light intensity sent by the UV light sensor 24 with the desired value $UV_{duration}$, determines the deviation of the actual value from the desired value, and issues a control signal which controls the cooling capacity of the radial fan 15. Herein, the reduction of the light intensity to $UV_{duration}$ is achieved by an intentionally non-optimized fan power; an adjustment of the operating parameters is not necessary. In the preferred exemplary embodiment, the fan power is set such that a temperature that is lower than the temperature required for reaching the absolute maximum develops at the amalgam depot 13. This method variant without adjustment of the operating parameters is indicated by the control point V2 in FIG. 3(*a*).

As a matter of course, it may also be expedient to combine the two described method variants for the purpose of the "service life compensation".

While the invention has been described in detail and with reference to specific embodiments thereof, it will be apparent to one skilled in the art that various changes and modifications can be made therein without departing from the spirit and scope thereof. Thus, it is intended that the invention covers the modifications and variations of this invention provided they come within the scope of the appended claims and their equivalents.

The invention claimed is:

1. A method for operating a lamp system including a gas discharge lamp, an electronic ballast and a control unit for controlling a performance influencing control variable of the lamp system, the method comprising the steps of:

providing a light intensity control in which an actual value of a light intensity emitted by the gas discharge lamp is measured using a light sensor and the emitted light intensity is used as a control variable; and determining a target value for an actuating variable using an extremum control, at which target value the light intensity adopts a maximum ($UV_{max}$) or a predefined threshold value ($UV_{duration}$).

2. The method of claim 1 wherein the gas discharge lamp emits UV radiation.

3. The method of claim 2 wherein the intensity of the UV radiation emitted by the gas discharge lamp is gathered as the light intensity, wherein the UV radiation includes radiation at a wavelength of 254 nm.

4. The method of claim 1 wherein the extremum control is realized as a two-point control in which, during a start phase, the actuating variable is set to at least two initial values, one of which causes a temperature increase, and the other of which causes a temperature reduction of the gas discharge lamp, wherein a maximum of the light intensity is reached and overstepped both as a result of the temperature increase and as a result of the temperature reduction, and in that a value between the one and the other initial value is set as the target value of the actuating variable.

5. The method of claim 1 wherein the extremum control includes a curvature determination of a transfer function of the actuating variable and the light intensity, wherein the target value of the actuating variable is determined on the basis of the maximum of the light intensity.

6. The method of claim 1 wherein an operating temperature of the gas discharge lamp influencing the light intensity is changed using a temperature control element with an adjustable temperature control power, and in that a temperature control power is used as an actuating variable of the control.

7. The method of claim 6 wherein the temperature control element is a fan with PWM-controlled ventilation power and in that the ventilation power is used as the actuating variable of the control.

8. A method for operating a lamp system including a gas discharge lamp, an electronic ballast and a control unit for controlling a performance influencing control variable of the lamp system, the method comprising the steps of:

providing a light intensity control in which an actual value of a light intensity emitted by the gas discharge lamp is measured using a light sensor and the emitted light intensity is used as a control variable; and predefining a threshold value of the light intensity ($UV_{duration}$), wherein falling below this threshold value indicates an end of a service life of the gas discharge lamp, and in that this threshold value is used as a desired value of the light intensity control.

9. The method of claim 8 wherein a target value for an actuating variable is determined using an extremum control, at which target value the light intensity adopts a maximum ($UV_{max}$) or a predefined threshold value ($UV_{duration}$).

10. The method of claim 9 wherein the extremum control is realized as a two-point control in which, during a start phase, the actuating variable is set to at least two initial values, one of which causes a temperature increase, and the other of which causes a temperature reduction of the gas discharge lamp, wherein a maximum of the light intensity is reached and overstepped both as a result of the temperature increase and as a result of the temperature reduction, and in that a value between the one and the other initial value is set as the target value of the actuating variable.

11. The method of claim 9 wherein the extremum control includes a curvature determination of a transfer function of the actuating variable and the light intensity, wherein the target value of the actuating variable is determined on the basis of the maximum of the light intensity.

12. The method of claim 8 wherein an operating temperature of the gas discharge lamp influencing the light intensity is changed using a temperature control element with an adjustable temperature control power, and in that a temperature control power is used as an actuating variable of the control.

13. A lamp system comprising:

a gas discharge lamp;

an electronic ballast;

a control unit for controlling a performance influencing control variable of the lamp system, the control unit including a device for extremum control, and a light sensor for determining an actual value of a light intensity emitted by the gas discharge lamp;

wherein control is configured as a light intensity control wherein the emitted light intensity is used as a control variable, wherein the actual value of the light intensity is available at a signal input of the control unit as an input signal, and wherein a target value for an actuating variable is determined, at which target value the light intensity adopts a maximum ($UV_{max}$) or a predefined threshold value ($UV_{duration}$).

14. The lamp system of claim 13 further comprising a temperature control element with controllable temperature control power, which is suitable for changing an operating temperature of the gas discharge lamp which influences the light intensity, and in that the operating temperature or a parameter correlated with the operating temperature is available at a signal input of the control unit and can be used as an actuating variable of the light intensity control.

15. The lamp system of claim 14 wherein a temperature control element with controllable cooling or heating capacity, in particular a fan with PWM-controlled ventilation power, is connected to the control unit.

16. The lamp system of claim 13 wherein the extremum control is designed as a two-point control or as a curvature determination of a transfer function of the actuating variable and the light intensity.

17. The lamp system of claim 13 wherein the gas discharge lamp emits UV radiation.

* * * * *